US005125621A

United States Patent [19]

Parsons et al.

[11] Patent Number: 5,125,621

[45] Date of Patent: Jun. 30, 1992

[54] FLUSH SYSTEM

[75] Inventors: Natan E. Parsons, Brookline; Joel S. Novak, Sudbury, both of Mass.

[73] Assignee: Recurrent Solutions Limited Partnership, Cambridge, Mass.

[21] Appl. No.: 678,084

[22] Filed: Apr. 1, 1991

[51] Int. Cl.[5] ..... F16K 31/40; E03D 5/10

[52] U.S. Cl. ..... 251/30.03; 251/41; 251/45; 251/30.05; 4/406; 4/DIG. 3

[58] Field of Search ..... 251/30.03, 41, 45; 4/406, DIG. 3

[56] References Cited

U.S. PATENT DOCUMENTS

| | | |
|---|---|---|
| 4,191,091 | 2/1979 | Pulvari . |
| 4,309,781 | 1/1982 | Lissau . |
| 4,611,356 | 9/1986 | Lin . |
| 4,709,427 | 12/1987 | Laverty, Jr. . |
| 4,729,342 | 3/1988 | Loctin . |
| 4,756,031 | 7/1988 | Barrett . |
| 4,793,588 | 12/1988 | Laverty, Jr. . |
| 4,805,247 | 2/1989 | Laverty, Jr. . |
| 4,823,414 | 4/1989 | Piersimoni et al. . |
| 4,891,864 | 1/1990 | Laverty, Jr. . |
| 4,941,215 | 7/1990 | Liu . |

FOREIGN PATENT DOCUMENTS 051517 5/1982 European Pat. Off. ..... 251/30.03

*Primary Examiner*—Arnold Rosenthal

*Attorney, Agent, or Firm*—Cesari & McKenna

[57] ABSTRACT

A replacement apparatus (50) for converting a manual flush mechanism to automatic operation includes a partition base (76) secured to a replacement cap (68) that forms two spaced-apart openings (96 and 98). A valve operator (58) is so mounted on the replacement cap (68) as to form with the upper surface of the replacement cap (68) a chamber (100) with which both of the openings (96 and 98) communicate. The partition base (76) separates a pilot chamber (26) from a relief chamber (94) that the partition base (76) and replacement cap (68) form. A replacement pilot valve member (102) controlled by the valve operator (58) in turn controls flow through the passage that comprises the openings (96 and 98) and the common chamber (100) with which they communicate. It thereby controls flow between the pilot chamber (26) and the relief chamber (94). The partition base (76) includes a wall (86) that is flexible so as to permit a main valve diaphragm (24) to flex. This organization permits the operator stroke to be much shorter than the flexure displacement of the center of the main diaphragm (24).

24 Claims, 14 Drawing Sheets

FLUSH SYSTEM

BACKGROUND OF THE INVENTION

The present invention is directed to flush systems for toilets and urinals. It finds particular application in replacement assemblies for converting manual flush systems to automatic operation.

Operators of public facilities have found that the use of automatic flush systems for toilets and urinals provides advantages in one or more of the areas of sanitation, water conservation, and maintenance cost. For this reason, much new construction employs automatic flush systems. Many of the facilities in which automatic flush systems would be most advantageous, however, have already been built with manual flush systems, and the conversion to automatic operation can involve costs that makes the desirability of the conversion problematic.

FIG. 1 depicts the typical existing manual flush system employed in most American urinals and many other toilet installations. The flush system 10 includes a body section 12 and an upper housing 14. The upper housing is removably secured to the body by threads 15. The body 12 is connected between an inlet line 16, which receives water from the main supply, and an outlet line 18 through which water flows to flush the urinal. The upper housing 14 holds in place a cap or dome 20, which defines, with the inner surfaces of the body 12, a composite chamber 22 divided in two parts by a flexible diaphragm 24. The upper chamber 26 is a pilot chamber, while the lower chamber 28 is the main chamber with which the inlet line 16 communicates.

The diaphragm 24 includes an annular main flexible diaphragm plate **24*a*, to the interior of which is secured an elongated cylindrical guide member 24*b* by a collar 24*c* and a retaining ring 24*d*. The collar 24*c* both stiffens the diaphragm assembly 24 and acts as a guide by virtue of an annular guide-flange portion 24*e* extending upward from its upper surface. At the lower end of the lower cylindrical guide 24*b* are provided spacer fins 24*f*, which engage the main outlet passage wall 35 while permitting the flow between wall 35 and the cylindrical guide member 24*b***.

An outlet conduit 29 that communicates with the outlet line 18 forms an outlet-defining main valve seat 30 at its upper end. The diaphragm 24 ordinarily is seated on the main valve seat 30 and thereby prevents water from flowing directly from the main chamber to the outlet line 18. The seal between the diaphragm 24 and the main valve seat 30 is effected by the force of water pressure in the pilot chamber 26. The diaphragm 24 forms a pressure-equalizing orifice 32, which enables the steady-state pressure in the pilot chamber 26 to equal that which prevails in the main chamber 28 as a result of its communication with inlet line 16. Since the surface area over which the pilot-chamber pressure acts on the top surface of the diaphragm 24 is greater than that over which the main-chamber pressure operates on the lower diaphragm surface, a net downward force seals the diaphragm 24 against the main valve seat 30.

The flush system is operated to flush the urinal by relieving the pressure in the pilot chamber 26 so that the main-chamber pressure causes the diaphragm to flex and lift from the main valve seat 30 and thereby permit rapid water flow from the inlet line 16 through the main chamber 28 and the outlet defined by the valve seat 30, from which water flows through the outlet line 18 to flush the urinal or toilet. This pressure is relieved through a relief opening 36 in the diaphragm 24, which is ordinarily stopped by a pilot valve member 38 seated in a pilot seat 40 that the diaphragm 24 forms around the relief opening 36.

By operating a lever 42, the user drives a plunger 44 against a pilot valve rod 46, which displaces the pilot valve member 38 from the pilot seat 40, thereby relieving the pilot-chamber pressure. Consequently, the main-chamber-pressure force overcomes the pilot-chamber-pressure force and flexes the diaphragm to the open position depicted in FIG. 2.

The pilot valve member 38 then falls back into the pilot seat 40, either because the user has released lever 42 or because the pilot valve member 38, which is slidably mounted on the pilot valve rod 46, slides down on it. Then, after a short delay determined by the inlet water pressure and the flow resistance of the equalizing orifice 32, the pressure inside the pilot chamber reaches a level high enough that the net force on the diaphragm 24 is again downward, and the seal of the diaphragm 24 to the main valve seat 30 is re-established.

A conventional way to convert a toilet or urinal to automatic operation is to remove the entire existing flush-control system 10, including the body 12 and the upper housing 14 together with all of their contents, from the inlet and outlet lines 16 and 18. An automatic system is then connected in its place to lines 16 and 18 and possibly wired to building power.

Clearly, this approach has some drawbacks if a large number of flush systems are to be replaced, as is often the case in large public facilities. Not only is the cost of each new automatic flush system a significant factor, but so is the loss incurred if the old flush systems are simply discarded, as they ordinarily have to be.

An approach less wasteful of the existing installed base would be more desirable, but there are reasons why replacement of the entire flush system has heretofore been favored. Any reduction in the loss from discarding the part may well be outweighed by the cost of performing a complicated replacement operation that retains existing parts. Moreover, if parts are retained by simply employing an electromechanical operator to operate the pilot valve member 38, the resultant power usage requires an electrical connection, large batteries, or frequent battery replacement.

To avoid the latter problem, some replacement flush units have employed a different approach to pilot-chamber pressure relief. In this approach, pressure is not relieved through a relief opening in the diaphragm. It is relieved instead through a relief passage provided in the body 12 between the pilot chamber 26 and the outlet line 18. This approach can avoid high power consumption because the pilot valve member can control the pilot-passage flow with an operating-member stroke that is short in comparison with that necessitated in the conventional manual system by the movement of the diaphragm that forms the relief opening. Unfortunately, such an approach necessitates replacement of the entire flush unit.

Another approach is exemplified by the device described in U.S. Pat. No. 4,793,588 to Laverty. In the Laverty arrangement, a replacement includes a cylindrical passage-defining extension that extends into from cap 20 to the opening 36 in the diaphragm with the outer cylindrical surface in slidable, sealing relationship with the diaphragm's opening-defining surface. The cap also forms a recess in which a "valve body" is mounted that defines two passages, one of which provides fluid communication with the pilot chamber, the other of which provides fluid communication a passage in the cylindrical extension that in turn communicates with the outlet 18. A solenoid controls communication between the two valve-body passages, and, because the "valve body" is stationary, the solenoid travel does not have to be great. However, the cylindrical extension requires a resilient sealing member such as an O-ring that must permit the (typically rubber) diaphragm with which it forms a seal to slide, and this requirement is difficult to meet while consistently avoiding binding or cocking of the diaphragm.

SUMMARY OF THE INVENTION

The present invention is an automatic flush arrangement that permits existing flush mechanisms to be converted to automatic operation without replacing the body of the existing flush mechanism, without causing excessive power use, and without having to overcome binding and cocking problems. According to one aspect of the invention, the use of the central relief opening in the main diaphragm is retained, without necessitating pilot-operator travel determined by the range of diaphragm motion, by providing a partition that meets or is integral with the diaphragm and forms a relief chamber around the relief passage in the diaphragm. The Laverty arrangement described above does this, too, but the partition in our device is a flexible member, such as an accordion-like tube extending from the relief opening in the diaphragm to another part of the partition provided by a modified portion of a cap otherwise similar to cap 20. The cap portion or an equivalent fixed-position part of the partition forms a pilot passage that extends from the relief chamber to the pilot chamber. Since this passage is in the fixed-position part of the partition, it can be controlled by a valve operating member having a very short stroke, but it requires no sliding seal.

An electromechanical pilot operator controls a pilot valve member, operating it between positions in which it respectively permits and prevents flow through the pilot passage to relieve the pilot-chamber pressure. The control circuit that drives the operator may respond to a manually generated switch or to some type of sensor, such as one that senses the presence of a person in the vicinity of the urinal or toilet. In the latter case, the control circuit responds to characteristics suggesting that the urinal or toilet has been used and the user has left by operating the pilot valve member and thereby flushing the urinal or toilet.

In accordance with another aspect of the invention, the converted flush mechanism operates in the same way except that the valve operator is mounted on the diaphragm so as to move with it. In such an arrangement, the partition member may be omitted.

According to yet another aspect of the invention, the relief path is not provided through a relief opening in the diaphragm, but replacement of the entire flush unit is still avoided. We accomplish this by providing the replacement unit with a tube that communicates under automatic-valve control with the pilot chamber and extends outside of the unit to a termination that fits in place of the retainer 48 that mounts the lever and thereby communicates with the outlet.

Since these designs result in short operator strokes, they do not require a lot of power, and they can readily be embodied in devices that require no external power source and can run on small batteries that need replacement less than once a year. Moreover, as it will be explained in detail below, they lend themselves to simple replacement procedures.

BRIEF DESCRIPTION OF THE DRAWINGS

These and further features and advantages of the present invention are described in connection with the accompanying drawings, in which.

DETAILED DESCRIPTION OF ILLUSTRATIVE EMBODIMENTS

Figure 1:
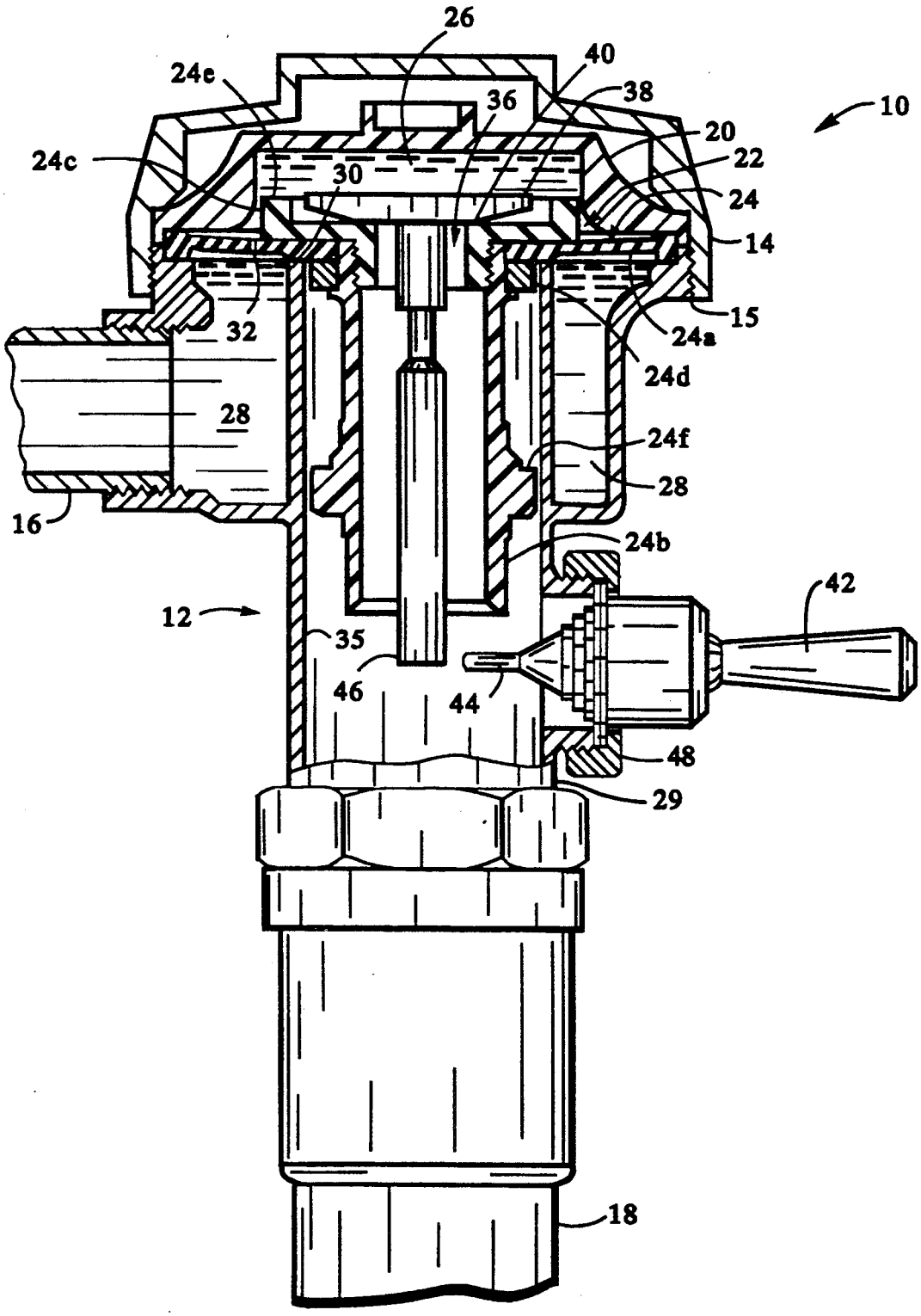
FIG. 1 is a cross-sectional view of a typical manual flush mechanism.
Figure 2:
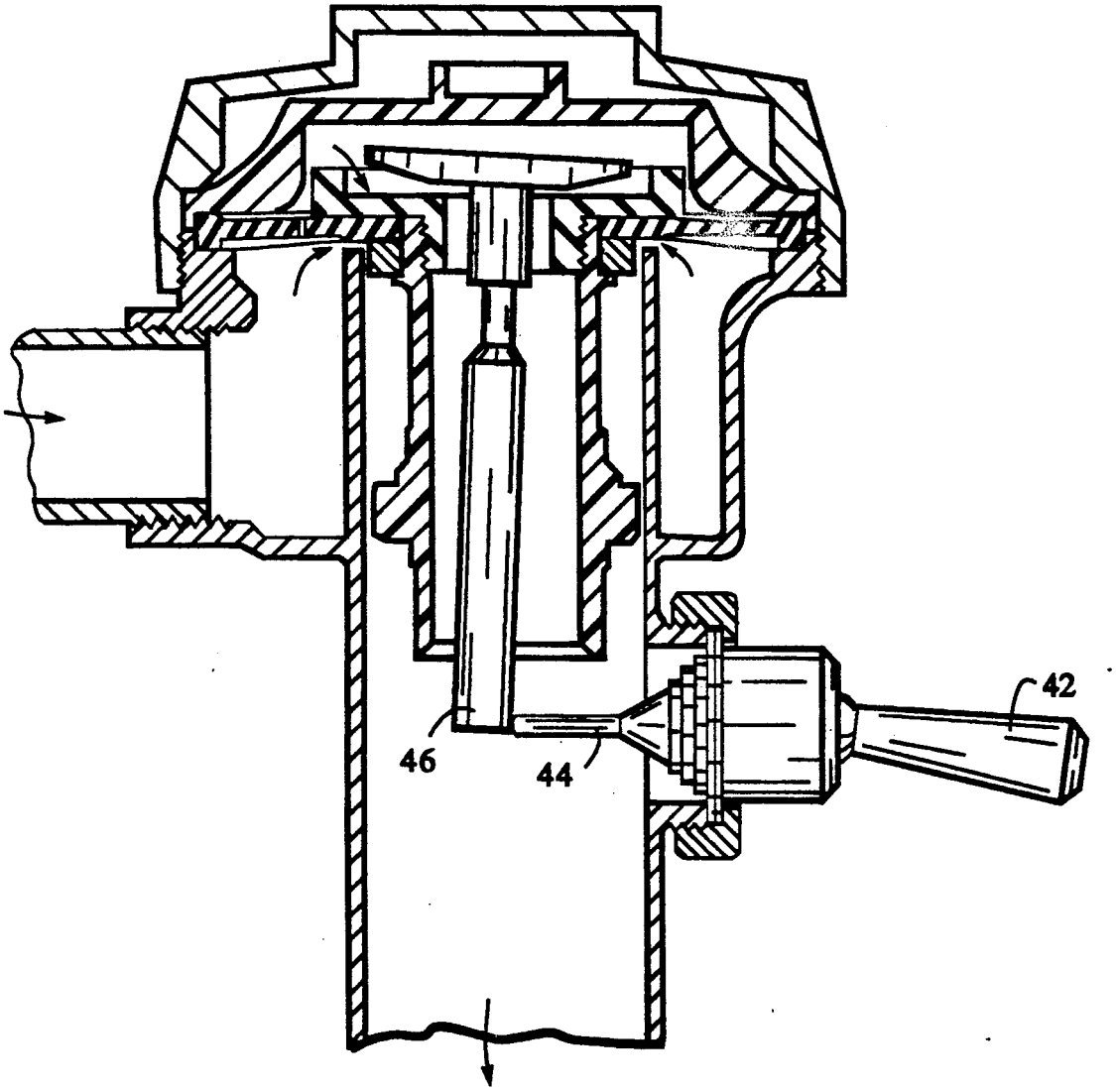
FIG. 2 is a view similar to FIG. 1 but showing the diaphragm in its open position.

To convert the flush mechanism of FIG. 1 to an automatic mechanism by employing the replacement assembly depicted in FIGS. 3 through 6, one first turns off the water pressure in the inlet line and unscrews the removable upper housing 14 from the body. With the upper housing 14 removed, the cap 20 is also removed, and this gives access to the pilot valve member 38 and the pilot valve rod 46, which are also removed.

In principle, the cap 20, pilot valve member 38, and pilot valve rod 46 are the only parts that have to be discarded. In practice, the lever 42 and plunger 40 are also removed. This is accomplished by unscrewing a retainer 48, removing the lever 42 and plunger 40 (FIG. 1), and replacing the retainer 48 with a dummy retainer 49 that is similar to the original retainer 48 but does not include the lever opening.

Figure 3:
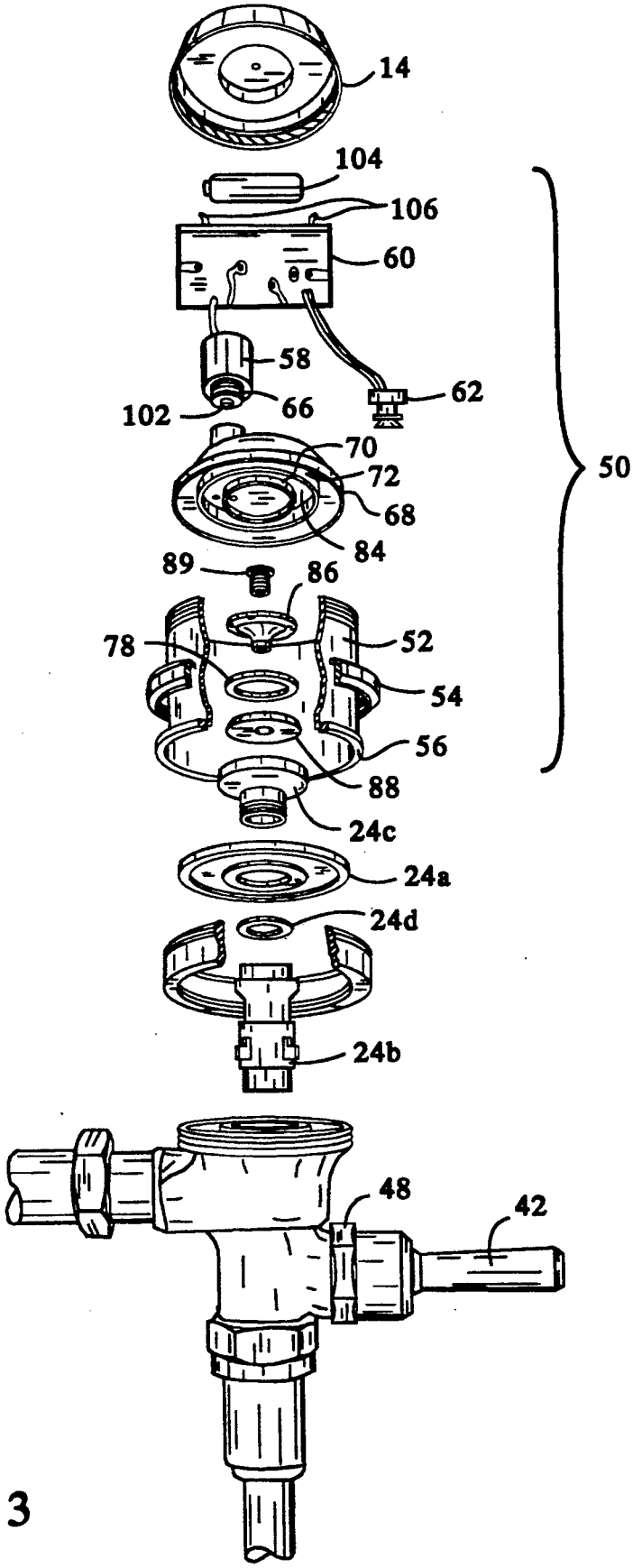
FIG. 3 is an exploded view of a flush mechanism that has been converted to automatic operation by incorporation of a replacement assembly that embodies the teachings of the present invention.
Figure 4:
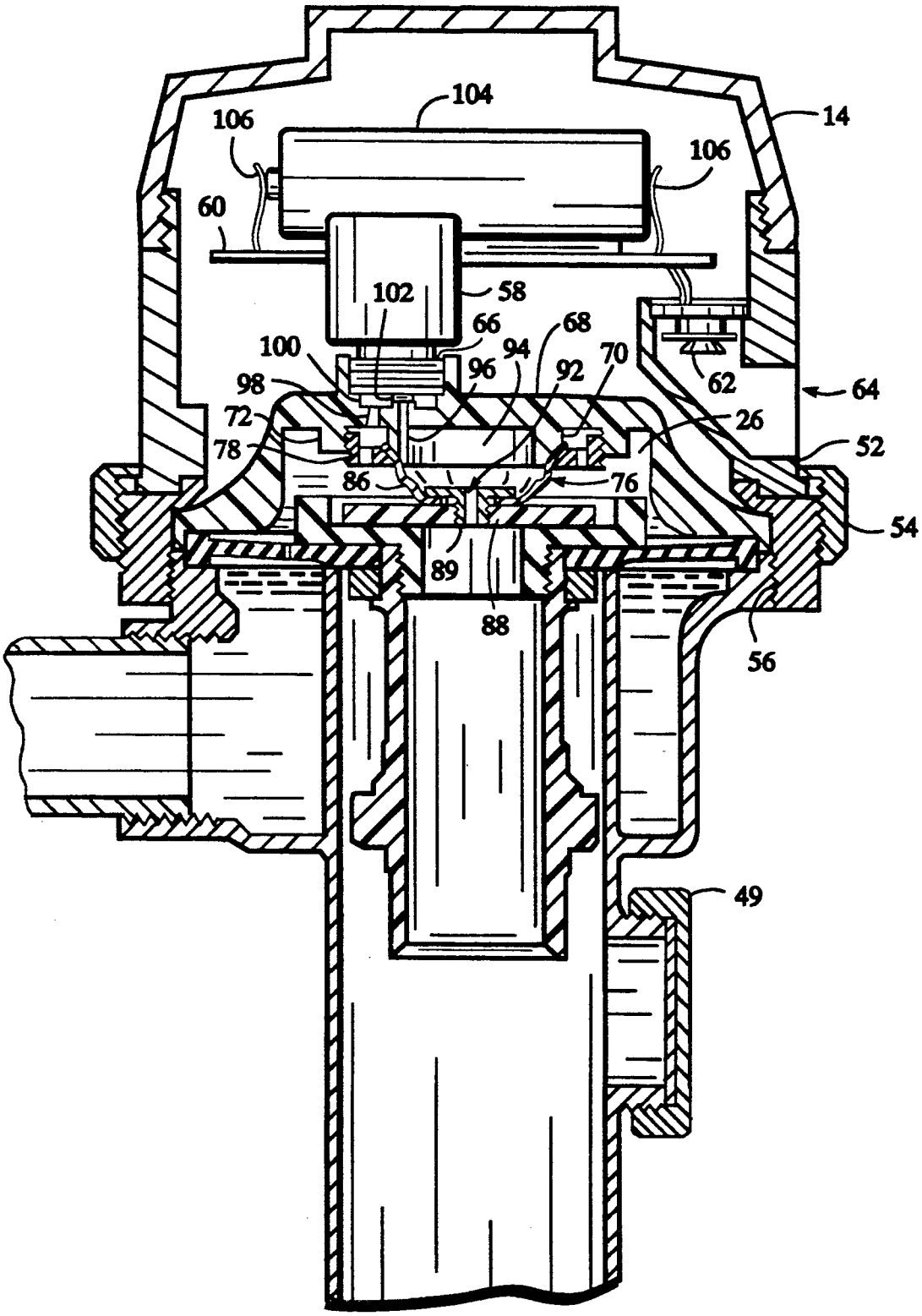
FIG. 4 is a sectional view of a flush mechanism that has been converted to automatic operation by incorporation of the replacement mechanism of FIG. 3.

The replacement apparatus 50 depicted in FIGS. 3 and 4 is then installed in place of the upper housing 14, which is then installed on the top of the apparatus 50. The water is then turned back on, and the urinal or toilet is ready for automatic operation.

Simultaneous reference to FIGS. 3 and 4 reveals that the replacement apparatus so includes a cylindrical sleeve 52 as well as a nut 54 rotatably mounted on the lower end of the sleeve 52 and including threads 56 for threadably securing the replacement apparatus to the body in a manner the same as that in which the original housing 14 was secured to it.

Mounted in the sleeve 52 are a latching solenoid operator 58 and a circuit board 60 containing control circuitry that controls the operator 58. Circuitry 60 also operates a sensor in the form of an ultrasonic transducer assembly 62. The transducer assembly 62 is oriented to transmit ultrasonic signals through an opening 64 in the sleeve 52, and the sleeve can be held stationary with the transducer assembly 62 pointed in the proper direction while the nut 54 is rotated to secure the assembly to the body 12.

The operator 58 terminates in a reduced-diameter boss 66 over which a replacement cap 68 is press fit. The replacement cap 68 replaces the original cap 20 but performs the same function of defining a pilot chamber with the diaphragm 24. The lower surface of the replacement cap 68 has inner and outer rings 70 and 72 formed in it. The inner ring 70 forms a beveled outer surface 74 against which the upper frustoconical end of a partition base 76 is held by a retainer ring 78, which is press fit onto the inner surface of the outer ring 72 so that a inner beveled surface thereof engages the partition base to hold it in place against the corresponding outer beveled surface of the inner ring 70. The retainer ring 78 forms a series of openings 82 that provide communication between the pilot chamber 26 and a generally annular space 84 formed by the inner and outer rings 70 and 72 and the retainer ring 78.

The partition base 78 includes a flexible, generally frustoconical upper portion 86 extending from the replacement cap 68 to a generally planar portion 88, which seats on the upper surface of the diaphragm 24 in such a manner as to close and is centered on the relief opening 36. Although FIG. 4 depicts the bottom surface of planar portion 88 as being strictly horizontal, it and corresponding elements of embodiments described below may be angled upward, as the lower surface of the discarded pilot valve member 38 is. In the illustrated embodiment, the frustoconical upper portion 86 and planar lower portion 88 are provided as separate pieces, which are secured to each other by a retainer 89 threadedly secured to the planar portion 88.

The upper portion 86 is preferably resilient so as to keep the planar portion 88 in its seat, but a separate spring may instead be used for that purpose. The generally planar portion 88 forms a partition-member opening 92.

Together, the partition base 76 and the central section of the replacement cap 68 form a partition that defines a relief passage or chamber 94 and separates it from the pilot chamber 26. The partition ordinarily prevents flow from the pilot chamber 26 through the relief opening 36 to the outlet line 18. In other words, although the planar portion 88 of the partition base is unlike the pilot valve member 38 in that it has an opening 92 through it, it still prevents from the pilot chamber 26 to the outlet line 18 because of the presence of the remainder of the partition.

The frustoconical portion 86 of the partition base is flexible so as to permit the pilot valve portion 88 to move with the motion of the main diaphragm 24 and thus allow diaphragm 24 to operate normally. For the purposes of the illustrated embodiment, the planar partition portion 88 does not additionally need to move with respect to the diaphragm 24, as the pilot-valve member 38 of the conventional manual system does; indeed, in a version of the invention in which the main diaphragm is additionally replaced, the partition 76 could be formed integral with the main diaphragm. The communication between the pilot chamber 26 and the outlet line 18 required to open the valve is not provided by movement of the planar portion with respect to the diaphragm 24 to permit flow around it. That communication occurs instead by flow through a pilot passage comprising openings 96 and 98 in the replacement cap 68, both of which lead to a chamber 100 formed between the end of the operator boss 66 and a relieved area in the upper surface of the replacement cap 68. This pilot passage is ordinarily stopped by a replacement pilot valve member 102, which fits over the end of the opening 96 that communicates with the relief chamber 94.

At rest, therefore, the resultant flush mechanism prevents flow in a manner similar to that in which the manual system does. Although the presence of the relief chamber 94 reduces the area over which the pilot pressure acts against the upper diaphragm surface, that area still is greater than the area over which the main-chamber pressure acts against the lower diaphragm surface, and a net downward force accordingly keeps diaphragm 24 sealed against its valve seat 30. The replacement pilot valve member 102 prevents the pressure in the pilot chamber 26 from being relieved into the relief chamber 94, and thus allows the small equalizing orifice 32 to keep the pilot-chamber pressure equal to the main-chamber pressure.

Figure 5:
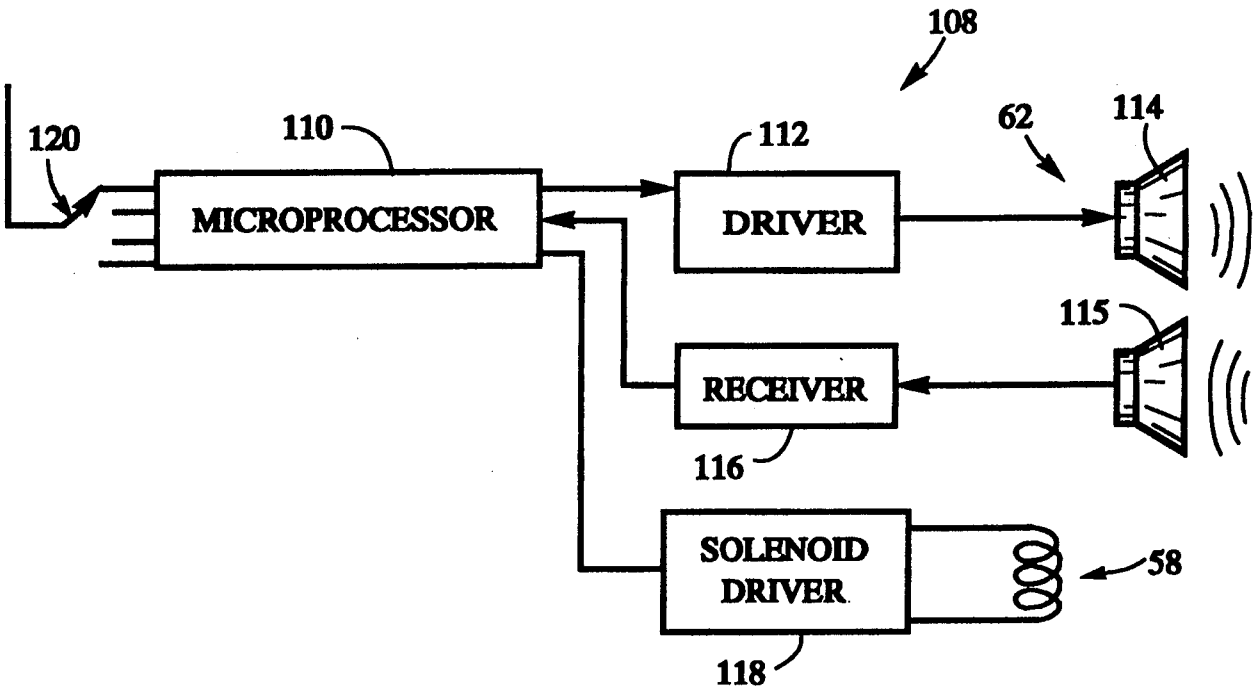
FIG. 5 is a block diagram of the circuitry that the mechanism of FIG. 3 employs.

Opening of the valve results from the operator's retraction of the replacement pilot valve member 102 so as to permit relief of the pilot-chamber pressure. This occurs in response to signals from the circuit board 60, which is powered by a battery 104 installed in a battery holder 106. FIG. 5 is a block diagram of the circuitry. A control circuit 108 including a microprocessor 110 repeatedly operates a transducer driver 112, which drives one transducer 114 of the transducer assembly 62 to send ultrasound into a region to be monitored. A second transducer 115 receives the reflected ultrasound and in response generates electrical signals that are conditioned by a transducer receiver 116 to produce an output that is suitable for monitoring by the microprocessor 110.

The microprocessor applies to the received signals predetermined criteria chosen to indicate that a user has used the facility and left and that the time is right to flush it. Many sets of criteria are known for this purpose, and the particular criteria chosen are not critical to the present invention. Employing some such criteria, the microprocessor 110 determines when to flush the urinal or toilet. It then operates a solenoid driver 118 to drive the operator 58, which is a latch-type solenoid; that is, it requires power only to change state and not to remain in either state.

By operating the driver 118, the microprocessor 110 causes the operator 58 to retract the replacement pilot-valve member 102, and this opens the pilot passage between openings 96 and 98. Since the passage is in a stationary part, the stroke required of the pilot-valve member 102 is much shorter than that required of the conventional pilot-valve member 38 (FIG. 1). With the valve member 102 retracted, water can flow from the pilot chamber 26 through opening 98 and opening 96 to the relief chamber 94 at a rate much faster than that at which water can flow through the equalization orifice 3 to equalize the pressure between the main chamber 28 and the pilot chamber 26. The balance of forces therefore switches to favor the main chamber 28, and the main-chamber pressure accordingly forces the diaphragm 24 to flex so as to lift its center section off the main valve seat 30 to the position shown in FIG. 6 and thus permit the main flow of water from the main chamber 28 through the outlet line 18.

Figure 6:
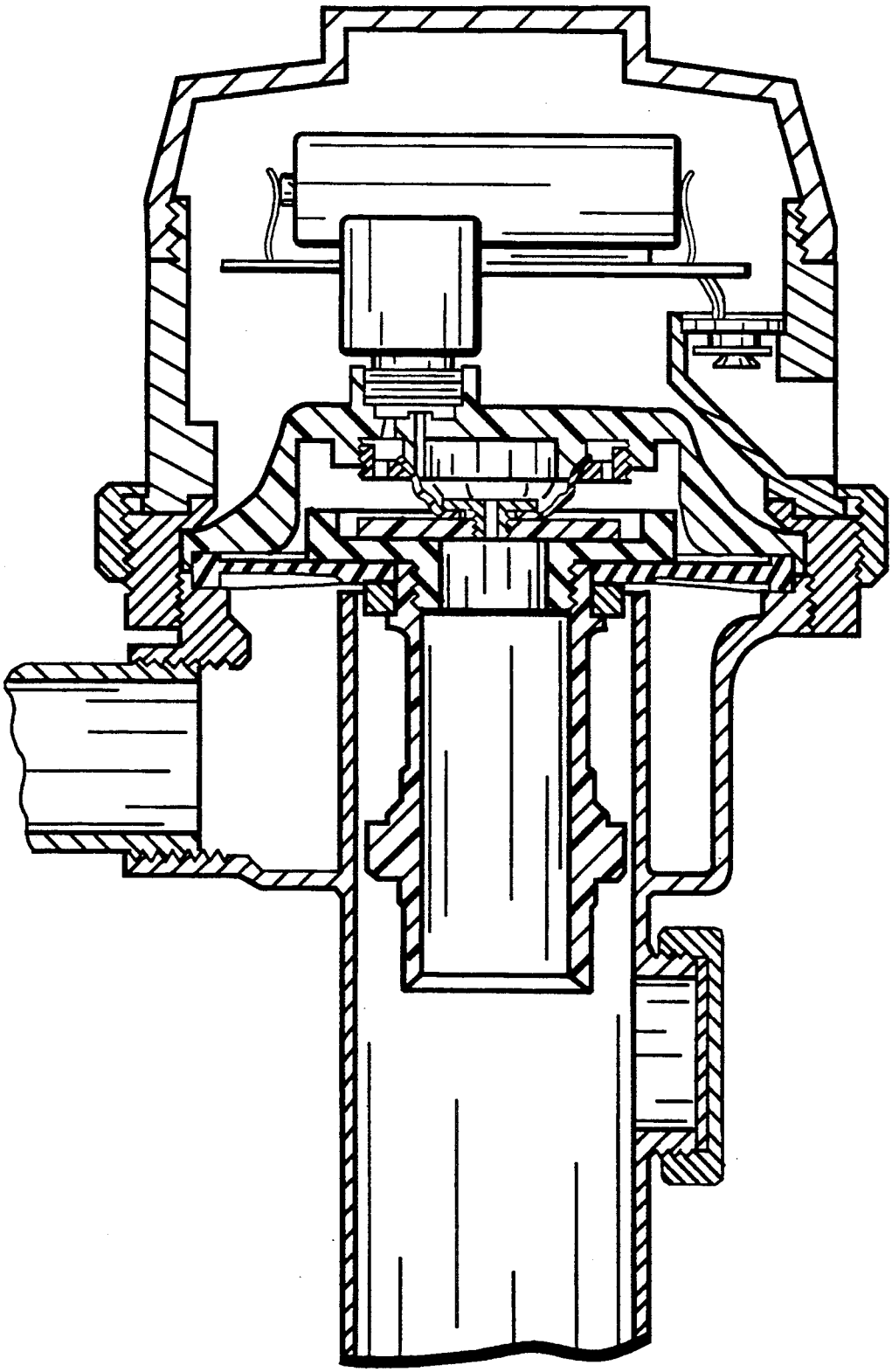
FIG. 6 is a sectional view similar to FIG. 4 but showing the diaphragm in the open position.
Figure 7:
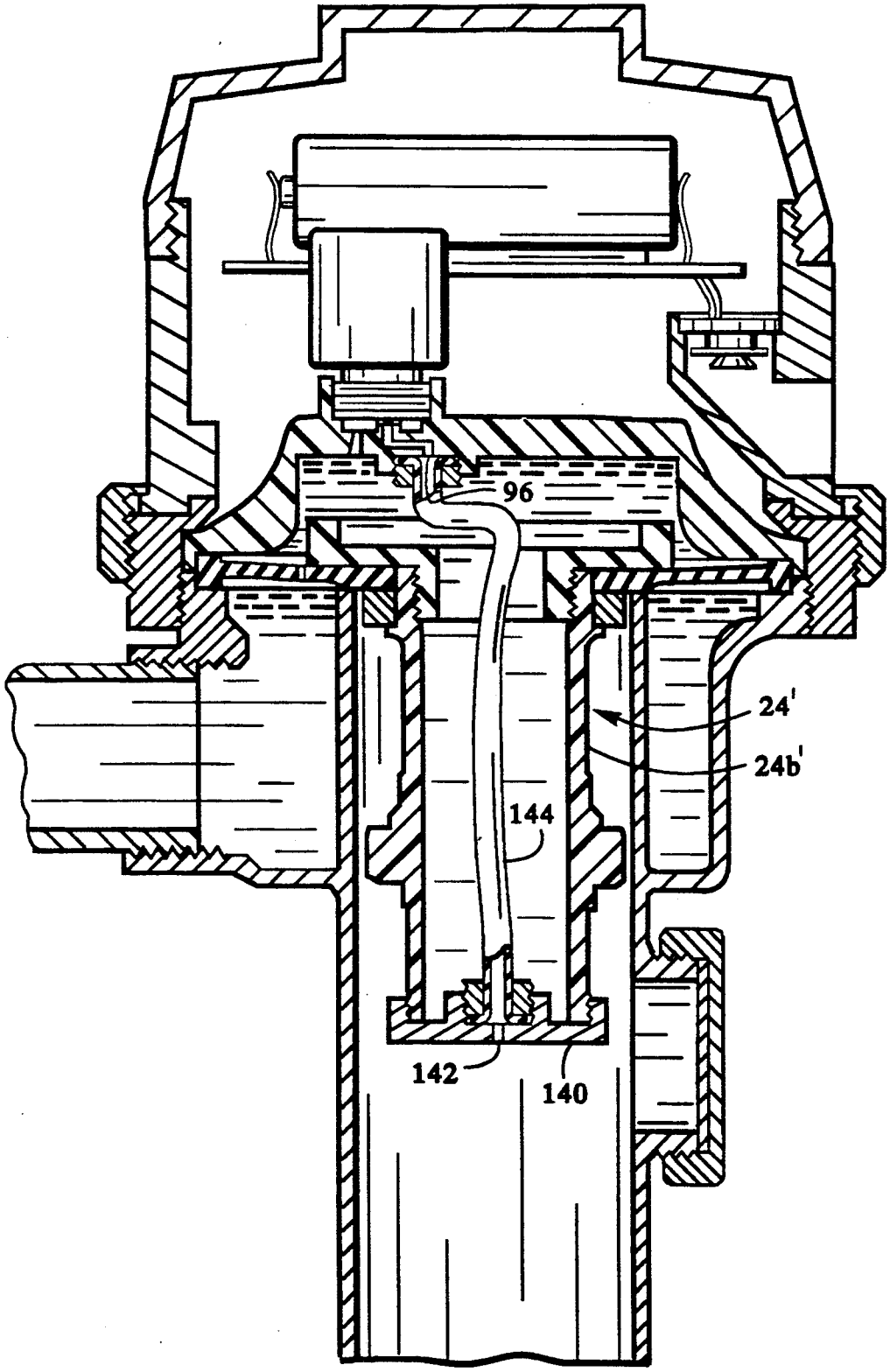
FIG. 7 is a sectional view of another embodiment of the invention.
Figure 8:
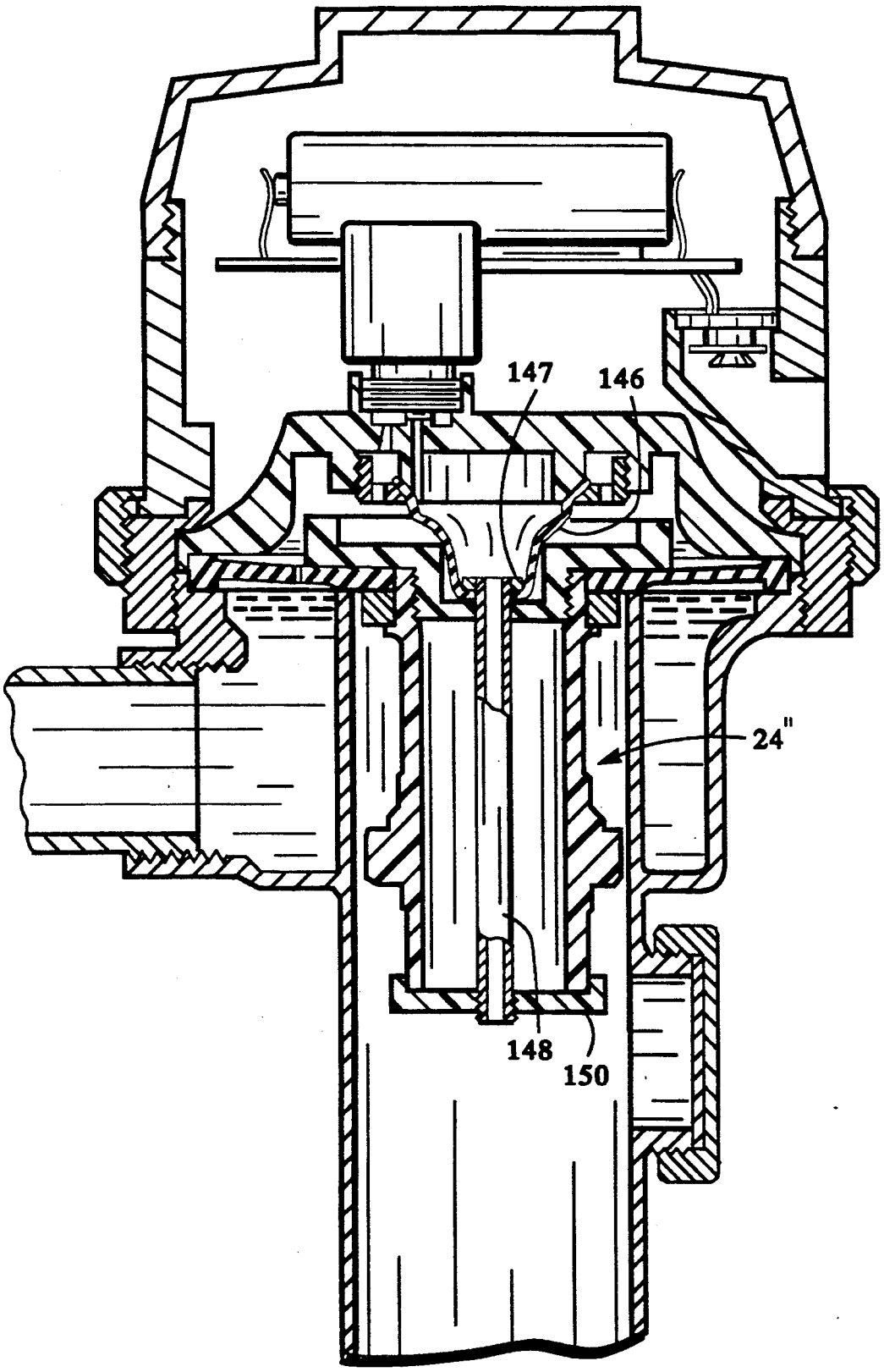
FIG. 8 is a sectional view of yet another embodiment of the invention.

The control circuit 108 keeps the valve in the position depicted in FIG. 6 for a predetermined time interval long enough to allow delivery of the water quantity required by the particular urinal or toilet. Preferably, the replacement unit is provided with a multi-position switch 120, which is set by the installer of the replacement apparatus to indicate the type of toilet or urinal into which the replacement apparatus is being placed. This selection tells the microprocessor how long the pilot passage should remain open in order to deliver the correct water volume. When the passage has remained open that long, the microprocessor 110 operates the solenoid driver 118 to drive the replacement pilot valve member 108 back into the position in which it stops the pilot-passage flow. The operator 58 is a latching operator, so power is required only to open the passage and close the passage; no power is required to keep the passage open or closed.

The closure of the pilot passage results in a buildup of pressure in the pilot chamber 26, and this pressure buildup eventually reaches the point at which the balance of forces across the diaphragm 24 again reverses, whereupon the diaphragm 24 is forced back into its rest position and water flow stops.

Figure 9:
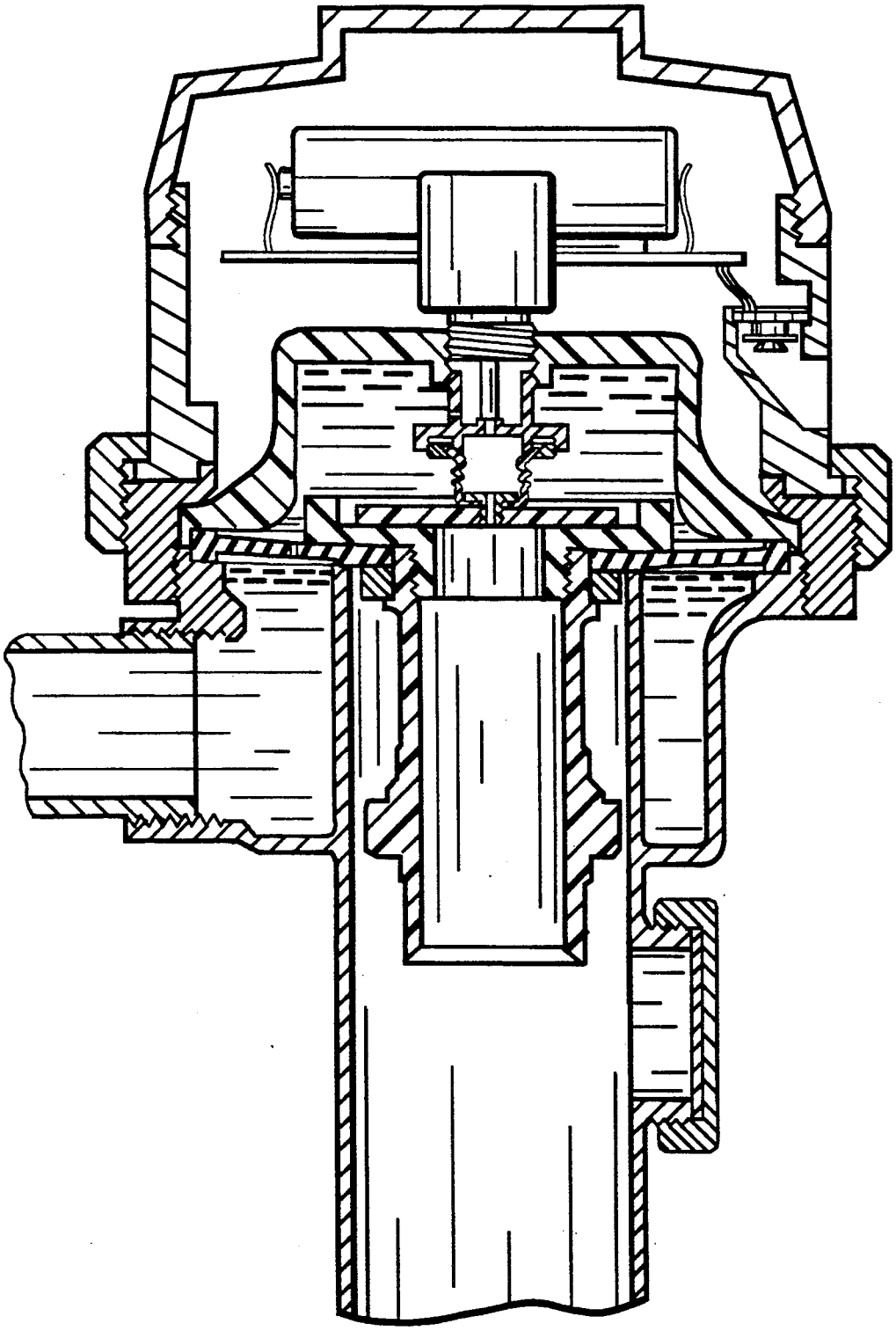
FIG. 9 is a sectional view of a further embodiment of the invention.

FIG. 9 depicts a variation of the invention. The arrangement of FIG. 9 is in essence the same as that of FIGS. 3–6, but it would typically be employed in embodiments in which conversion to automatic operation involves replacement of the entire diaphragm assembly 24 of FIGS. 3–6 with the diaphragm assembly 24' of FIG. 9. This diaphragm assembly differs from assembly 24 of FIGS. 3–6 only in that its cylindrical guide member **24*b*' is threaded at the bottom to receive a diaphragm cap 140, which forms a central aperture 142, which acts as the relief outlet; that is, the relief outlet has in essence been moved from the top of the diaphragm assembly 24 of FIGS. 3–6 to the bottom of the diaphragm assembly 24' of FIG. 9. Accordingly, dividing the pilot chamber from the relief outlet now requires a long flexible tube 144 leading from the pilot-passage opening 96 to the relief opening 142. In all other respects, the embodiment of FIG. 9 operates just as that of FIGS. 3–6** does.

Figure 10:
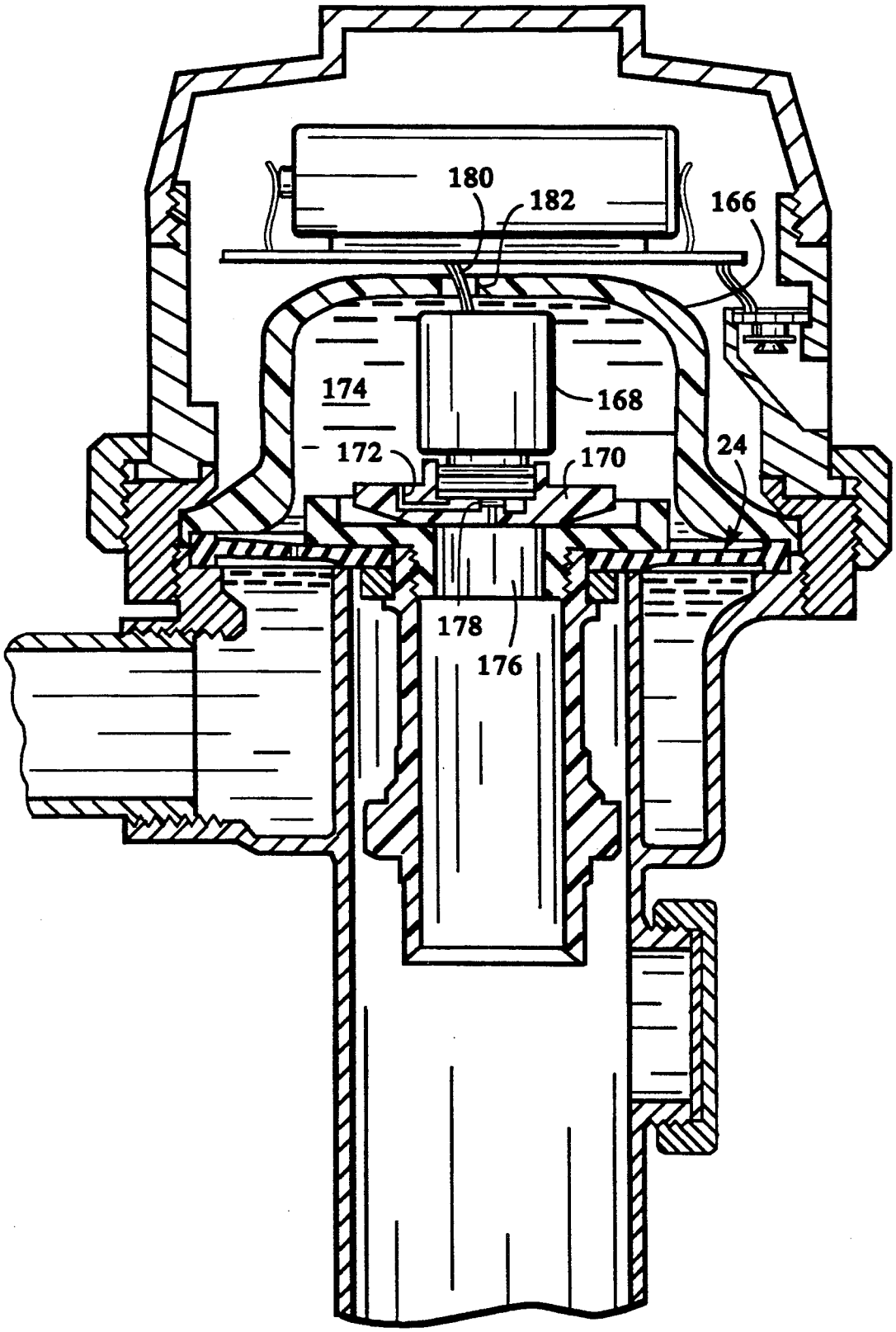
FIG. 10 is a sectional view of a still further embodiment of the invention.

FIG. 10 depicts yet another arrangement for carrying out the teachings of the present invention. The arrangement of FIG. 10 is the same as that of FIGS. 3–6 except that the partition base maintains its seal to the diaphragm assembly 24'' by means of pressure applied to it by an enlarged boss 147 on the upper end of a tube 148 kept in tension by an end cap 150 on the guide portion of the modified diaphragm assembly 24''.

Figure 11:
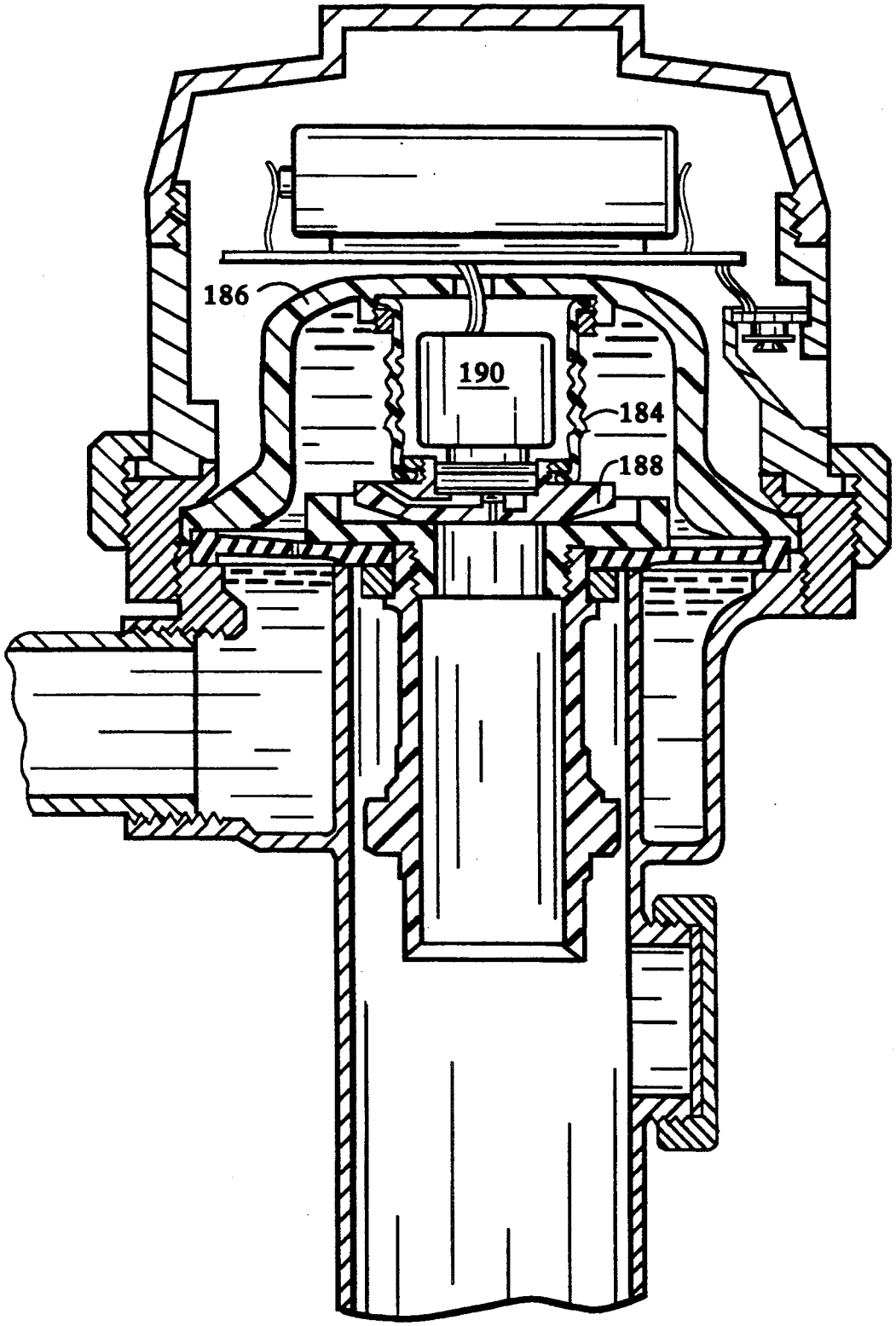
FIG. 11 is a sectional view of yet another embodiment of the invention.

In all of the embodiments so far, the partition, which separates the pilot chamber from the relief chamber and relief outlet, includes part of the chamber-forming cap, which thereby has opening such as openings 94 and 96 of FIG. 4 to provide a pilot passage. FIG. 11 illustrates that such an arrangement is not necessary in order to practice the teachings of the present invention. In FIG. 11, the cap 151 does not provide the pilot passage; it provides only a single opening 152 through which an elongated valve operating member 154 extends into the pilot chamber in such a manner as to stop an opening 155 in an upper, rigid wall 156 of a partition member 158. Legs 160 extend from the cap 151 to the upper wall 156 to hold it in a fixed position with respect to the cap 151, while accordion-like flexible sidewalls 162 extend from the upper, rigid wall 156 to the main diaphragm 24. Reflection will reveal that such an arrangement operates in essentially the same manner as do those of the preceding embodiments.

Figure 12:
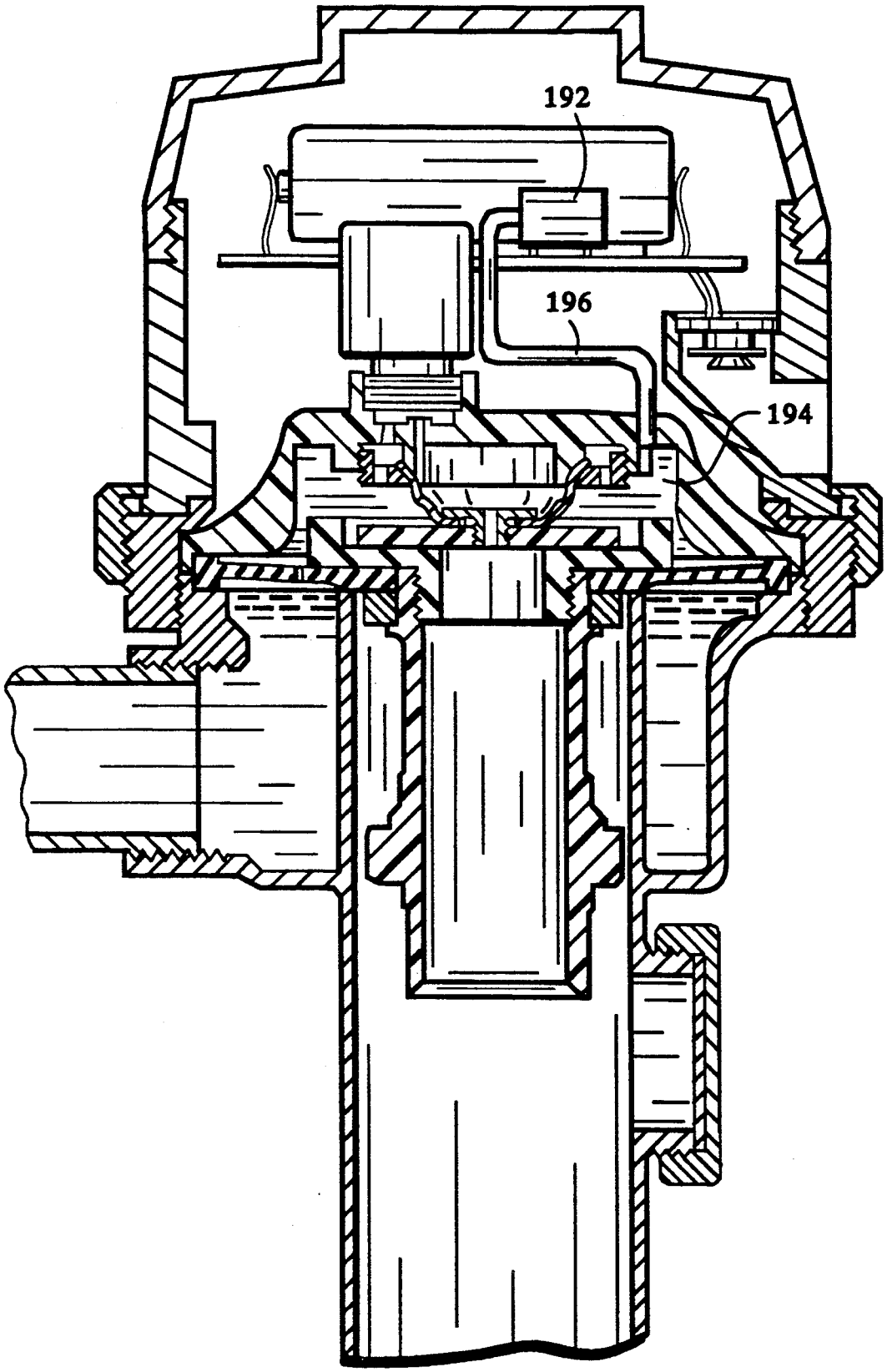
FIG. 12 is a sectional view of another embodiment of the invention

In this embodiment, as in all of the previous embodiments, the goal of minimizing the travel of the pilot operating member has been achieved by permitting relative motion between the diaphragm and the pilot passage through which the pilot operating member controls the flow. FIG. 12 depicts an embodiment that employs a different approach to achieving the same results. In the arrangement of FIG. 12, the chamber-forming cap 166 is made considerably larger also as to enable it to accommodate a water-tight operator 168 disposed inside it and snap fit into a stop member 170, which seats on the diaphragm assembly 24. The stop member 170 forms the pilot passage 172 between the (enlarged) pilot chamber 175 and the relief outlet 176 in the diaphragm 124. A pilot valve member 178 controlled by the pilot operator 168 is so disposed as to control the flow through the passage 172.

The operator 168 is thus mounted on the diaphragm 24 so as to move with it. Indeed, the operator could alternatively be positively secured to a diaphragm modified for that purpose. As a result, no provision is required for accommodating relative motion between the pilot passage 172 and the relief outlet 176 in order to keep the travel of the pilot valve member 78 short. The only flexible members required are conductors 180 that pass through a sealing grommet 182 in cap 166 so as to provide electrical communication between the operator 168 and the control circuitry.

Figure 13:
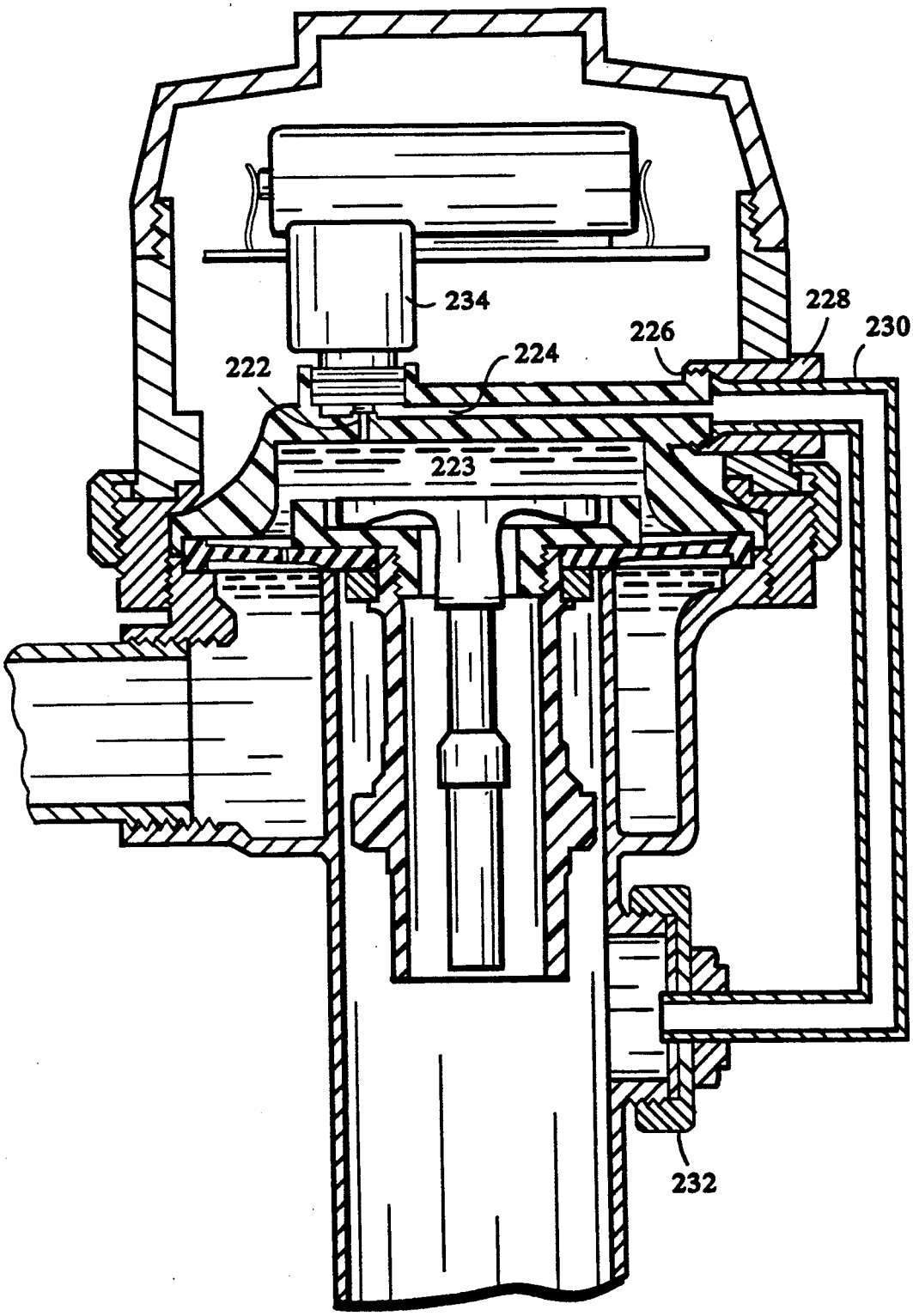
FIG. 13 is a sectional view of another embodiment of the invention.

If is it desired to avoid the use of a watertight operator such as operator 168, one can employ the arrangement of FIG. 13, in which an accordion-like flexible wall 184 extends from the cap 186 to a stop 188 so as to prevent access of water to the non-watertight operator 190.

While the foregoing embodiments of the present invention have retained the central aperture in the main diaphragm as the route through which to relieve the pilot-chamber pressure, FIG. 9 depicts an embodiment that does not but that nonetheless enables existing manual flush valves to be converted to automatic operation without excessive waste of existing parts. The approach employed in FIG. 13 would, like previous embodiments, typically employ a sensor for operating the valve. FIG. 13 does not show the sensor, however, which would typically be located in the part of the assembly forward of the plane of the page. In the arrangement of FIG. 13, the cap 220 is like the cap in previous embodiments in that it forms one passage 222 that communicates with a pilot chamber 223. However, it forms the second passage 224 that does not communicate with the valve outlet through the central aperture in the main diaphragm. Instead, the passage 224 terminates in a threaded extension 226 of the cap 220 to which a nut 228 secures a tube 230 by means of a flare fit. Of the tube 230 terminates in a retainer 232, which replaces retainer 48 and secures the other end of the tube 230 to the body 12 in communication with the outlet 18 thereof. The solenoid 234 in this arrangement controls the communication between passages 222 and 224 and thus relieves the pilot pressure when the flush valve is to be operated.

The arrangement of FIG. 13 thus bypasses the central aperture of the main diaphragm without the need for replacing the body portion 12 although it requires an external conduit 230, it may be found advantageous in certain applications. Moreover, it provides added design flexibility, since the pilot valving can be positioned not only as it is in FIG. 13, at the junction of passages 222 and 224 but also at other positions as well. For instance, passages 222 and 224 could be provided as a single, unvalved passage through the cap 220, while the valving could be provided, for instance, in a part mounted on the replacement retainer 232 to provide the valving at the body of tube 230.

The control arrangement described in connection with FIG. 5 is clearly applicable to any of the embodiments described so far. As was stated in connection with the discussion of that drawing, a switch such as switch 120 can be used to indicate the type of facility into which the replacement assembly is to be installed. The position of the switch controls the amount of water allowed to flow as a result of each actuation. But the flow volume may additionally be made to depend on other factors.

Figure 14:
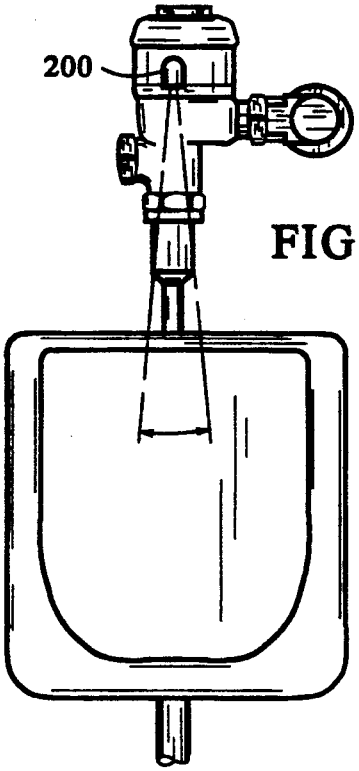
FIG. 14 is a front elevation of a urinal illustrating a control strategy to be used in connection with the present invention.

For instance, the arrangement of FIG. 14 additionally includes a static-pressure sensor 192, which senses the pressure inside the pilot chamber 194 by means of a tube 196. The pressure transducer 192 applies its output to the microprocessor or other components of the control circuitry, which varies the open time of the pilot valve member in response to the sensed pressure. An appropriate relationship between pressure and valve-open time reduces the variation in flow volume that can result from variations in inlet pressure. Clearly, such a scheme can be employed alone or together with the manual settings provided by an input device such as switch 120.

Clearly, this approach can be employed with any of the mechanical embodiments described above. In all of these, it has so far been assumed that the control approach is essentially one of the type described in connection with FIG. 5, which employs ultrasound to detect objects in the vicinity and operates the valve in response to predetermined characteristics of the detected objects But other object-detection arrangements can be employed as well; detection by infrared radiation is a popular example of the many types currently used.

Figure 15:
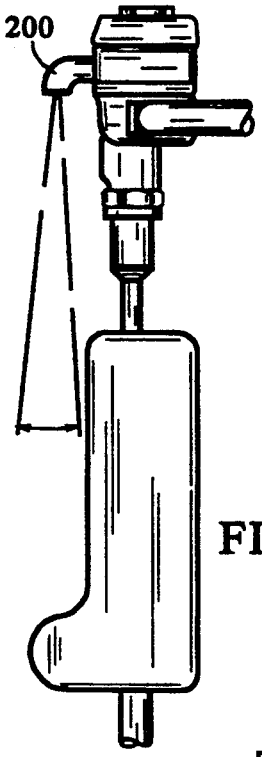
FIG. 15 is a side elevational view of the urinal of FIG.
Figure 16:
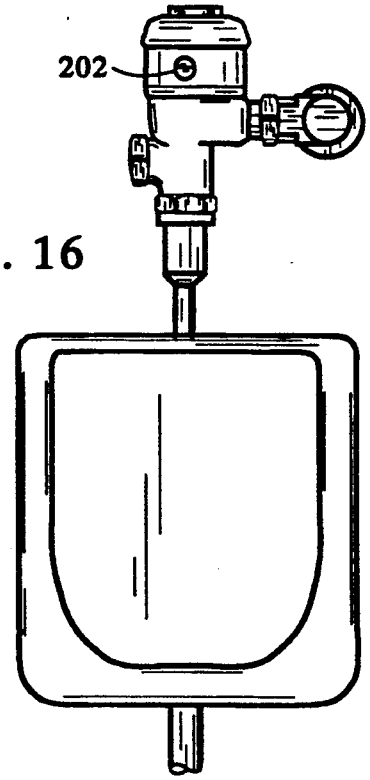
FIG. 16 is a front elevational view of a urinal for illustrating another control strategy.

Moreover, detection of the presence of a person and his subsequent absence is not the only basis on which one might trigger a flushing mechanism that embodies the teachings of the present invention. FIGS. 15 and 16, for instance, depict a urinal in which a directional microphone 200 passively monitors a target region for sounds characteristic of the use of the facility and the control circuitry responds to the characteristic sounds by permitting water flow a predetermined time after the characteristic sounds have ended. This is but one of a wide range of control schemes that can be employed with the teachings of the present invention.

Figure 17:
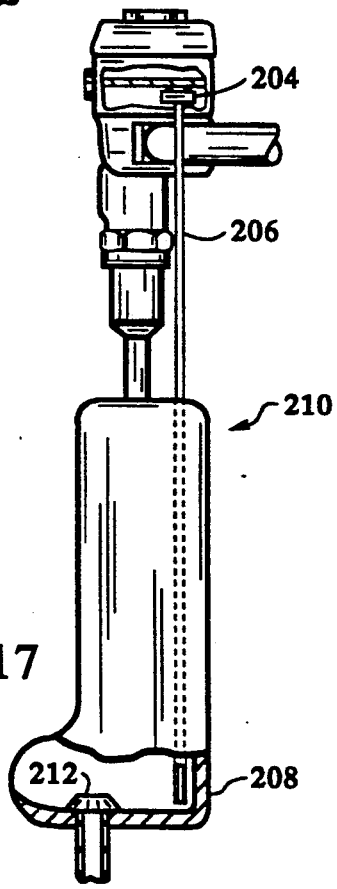
FIG. 17 is a side elevational view of urinal for illustrating yet another control strategy to be employed with the present invention.

Indeed, the flushing mechanism does not have to be "automatic" in the normal sense in order to employ the teachings of the present invention. FIG. 17, for instance, depicts an arrangement in which a manual momentary switch 202, operable by the user, conveys to the control circuitry a command by the user to flush the urinal. Such an arrangement might be desirable in hostile environments, such as prisons, in which it is desirable to permit flushing in response to a user command but only at predetermined intervals and for predetermined durations.

The arrangement depicted in FIG. 18 can be employed in similar environments. That version has a static-pressure sensor 204 connected by an air tube 206 to the base 208 of a urinal 210, where it senses the fluid pressure in that location. When it senses a pressure head indicative of a clogged drain 212, it can prevent normal flushing and thus overflow. A similarly positioned pH sensor could be used to trigger flushing.

It is thus apparent that the teachings of the present invention can be employed in a wide range of embodiments and that the invention accordingly constitutes a significant advance in the art.

We claim:

1. A flush-control mechanism comprising:

A) a body portion providing an inlet, an outlet, and a valve seat at the outlet, B) a cap secured to the body portion and forming therewith a composite chamber;

C) a diaphragm secured in the composite chamber, dividing the composite chamber into a main chamber and a pilot chamber and being flexible between an open state, in which it is spaced from the valve seat and permits flow from the inlet through the main chamber to the outlet, and a closed state, in which it seats against the valve seat and prevents flow from the inlet through the main chamber to the outlet, and providing a relief opening therethrough for flow from the pilot chamber to the outlet;

D) a partition forming a relief chamber communicating with the relief opening, generally separating the pilot chamber from the relief chamber and the relief opening but permitting flexure of the diaphragm and including a control portion, fixed in position with respect to the cap, that forms a pilot passage so positioned that the partition prevents flow between the pilot and relief chambers except through the pilot passage, and a flexible wall member extending between the fixed-position control portion and the diaphragm;

E) a pilot valve member;

F) a latching pilot operator, adapted for application of operator control signals thereto, for responding to the operator control signals by operating the pilot closes the pilot passage so as to prevent fluid flow therethrough, and second position, in which it permits fluid flow therethrough; and G) a control circuit for applying operator control signals to the operator.

2. A flush-control mechanism as defined in claim 1 wherein:

A) the mechanism further includes a manually operable entry device for making a type selection; and B) the control circuit comprises means for responding to the predetermined characteristics by causing the pilot operator to operate the pilot valve member to the second position for a period of time dependent on the type selection and then return it to the second position.

3. A flush-control mechanism as defined in claim 1 wherein:

A) the flush-control mechanism further includes a battery; and

B) the control circuit is connected to the battery to be powered thereby.

4. A flush-control mechanism as defined in claim 1 wherein part of the cap provides the partition control portion that forms the pilot passage.

5. A flush-control mechanism as defined in claim 1 wherein:

A) the flush-control mechanism further includes a sonic sensor for sensing sound in a predetermined target region and generating sensor signals representative of the sensed sound; and B) the control circuit is responsive to the sensor signals to operate the pilot valve member by applying operator control signals to the pilot operator in response to predetermined characteristics of the sensed sound.

6. A flush-control mechanism as defined in claim 1 wherein:

A) the flush-control mechanism further includes a sensor operable by application of drive signals thereto to monitor a predetermined target region for objects and generate sensor signals representative of detection of an object in the neighborhood; and B) the control circuit is responsive to the sensor signals to operate the pilot valve member by applying operator control signals to the pilot operator in response to predetermined characteristics of the object detected.

7. A flush-control mechanism as defined in claim 6 wherein the sensor comprises a sonic sensor operable by application of drive signals thereto to transmit sound into the target region and generate the sensor signals in response to reflected sound received thereby.

8. A flush-control mechanism as defined in claim 6 wherein the sensor comprises an infrared sensor for transmitting infrared radiation in to the predetermined target region and generating the sensor signals in response to receipt of reflected radiation received thereby.

9. A flush-control mechanism as defined in claim 1 wherein:

A) the flush-control mechanism further includes a manually operable switch; and

B) the control circuit is responsive to operation of the switch to operate the pilot valve member by applying operator control signals to the pilot operator.

10. For converting to automatic operation a flush mechanism of the type that includes a body portion providing an inlet, an outlet, and a valve seat at the outlet, an original cap removably secured to the body portion and forming therewith gera composite chamber, a diaphragm secured in the composite chamber, dividing the composite chamber into a main chamber and a pilot chamber, being flexible between an open state, in which it is spaced from the valve seat and permits flow from the inlet through the main chamber to the outlet, and a closed state, in which it seats against the valve seat and prevents flow from the inlet through the main chamber to the outlet, and providing a relief opening therethrough for flow from the pilot chamber to the outlet, and a pilot valve member operable between a first position, in which is prevents flow through the relief opening, and a second position, in which it permits such flow, a replacement assembly comprising:

A) a replacement cap that forms a composite chamber with the body when the replacement cap is mounted on the body in place of the original cap;

B) a partition including a control portion fixed in position with respect to the replacement cap and a flexible wall member extending between the fixed-position control portion and the diaphragm, the partition (i) forming a relief chamber communicating with the relief opening, (ii) permitting flexure of the diaphragm, and (iii) generally separating the pilot chamber from the relief chamber and the relief opening when the replacement cap is secured to the body, the control passage forming a pilot passage therethrough so positioned that the partition prevents flow between the pilot and relief chambers except through the pilot passage;

C) a replacement pilot valve member movably mounted for translation, when the replacement cap is mounted on the body in place of the original cap, between a first position, in which it closes the pilot passage so as to prevent fluid flow therethrough, and a second position, in which it permits fluid flow therethrough;

D) a latching pilot operator, secured to the replacement cap and adapted for application of operator control signals thereto, for responding to the operator control signals by operating the replacement pilot valve member between the first and second positions thereof; and E) a control circuit for applying operator control signals to the sensor operator.

11. A replacement assembly as defined in claim 10 wherein:

A) the mechanism further includes a manually operable entry device for making a type selection; and B) the control circuit comprises means for responding to the predetermined characteristics by causing the pilot operator to operate the pilot valve member to the second position for a period of time dependent on the type selection and then return it to the second position.

12. A replacement assembly defined in claim 10 wherein:

A) the flush-control mechanism further includes a sonic sensor for sensing sound in a predetermined target region and generating sensor signals representative of the sensed sound; and B) the control circuit is responsive to the sensor signals to operate the pilot valve member by applying operator signals to the pilot operator in response to predetermined characteristics of the sensed sound.

13. A replacement assembly defined in claim 10 wherein:

A) the flush-control mechanism further includes a sensor operable by application of drive signals thereto to monitor a predetermined target region for objects and generate sensor signals representative of detection of an object in the neighborhood; and B) the control circuit is responsive to the sensor signals to operate the pilot valve member by applying operator signals to the pilot operator in response to predetermined characteristics of the object detected.

14. A replacement assembly as defined in claim 13 wherein the sensor comprises a sonic sensor operable by application of drive signals thereto to transmit sound into the target region and generate the sensor signals in response to reflected sound received thereby.

15. A replacement assembly as defined in claim 13 wherein the sensor comprises an infrared sensor for transmitting infrared radiation in the predetermined target region and generating the sensor signals in response to receipt of reflected radiation received thereby.

16. A replacement assembly as defined in claim 10 wherein:

A) the flush-control mechanism further includes a battery; and

B) the control circuit is connected to the battery to be powered thereby.

17. A replacement assembly as defined in claim 10 wherein part of the cap provides the partition control portion that forms the pilot passage.

18. A replacement assembly as defined in claim 10 wherein:

A) the flush-control mechanism further includes a manually operable switch; and

B) the control circuit is responsive to operation of the switch to operate the pilot valve member by applying operator control signals to the pilot operator.

19. A flush-control mechanism comprising:

A) a body portion providing an inlet, an outlet, and a valve seat at the outlet, B) a cap secured to the body portion and forming therewith a composite chamber;

C) a diaphragm secured in the composite chamber, dividing the composite chamber into a main chamber and a pilot chamber and being flexible between an open state, in which it is spaced from the valve seat and permits flow from the inlet through the main chamber to the outlet, and a closed state, in which it seats against the valve seat and prevents flow from the inlet through the main chamber to the outlet, and providing a relief opening therethrough for flow from the pilot chamber to the outlet;

D) a partition forming a relief chamber communicating with the relief opening, generally separating the pilot chamber from the relief chamber and the relief opening but permitting flexure of the diaphragm and including a control portion, fixed in position with respect to the cap, that forms a pilot passage so positioned that the partition prevents flow between the pilot and relief chambers except through the pilot passage, and a flexible wall member extending between the fixed-position control portion and the diaphragm;

E) a pilot valve member;

F) a pilot operator, adapted for application of operator control signals thereto, for responding to the operator control signals by operating the pilot valve member between a first position, in which it closes the pilot passage so as to prevent fluid flow therethrough, and second position, in which it permits fluid flow therethrough;

G) a pressure sensor for sensing a pressure in the composite chamber and generating a pressure signal indicative thereof; and H) a control circuit responsive to the pressure signal for applying operator control signals to the operator so as to cause it to operate the pilot valve member to the second position for a period of time dependent on the pressure signal and then return it to the first position.

20. A flush-control mechanism comprising:

A) a body portion providing an inlet, an outlet, and a valve seat at the outlet, B) a cap secured to the body portion and forming therewith a composite chamber;

C) a diaphragm secured in the composite chamber, dividing the composite chamber into a main chamber and a pilot chamber and being flexible between an open state, in which it is spaced from the valve seat and permits flow from the inlet through the main chamber to the outlet, and a closed state, in which it seats against the valve seat and prevents flow from the inlet through the main chamber to the outlet, and providing a relief opening therethrough for flow from the pilot chamber to the outlet;

D) a partition forming a relief chamber communicating with the relief opening, generally separating the pilot chamber from the relief chamber and the relief opening but permitting flexure of the diaphragm and including a control portion, fixed in position with respect to the cap, that forms a pilot passage so positioned that the partition prevents flow between the pilot and relief chambers except through the pilot passage, and a flexible wall member extending between the fixed-position control portion and the diaphragm;

E) a pilot valve member;

F) a pilot operator, adapted for application of operator control signals thereto, for responding to the operator control signals by operating the pilot valve member between a first position, in which it closes the pilot passage so as to prevent fluid flow therethrough, and second position, in which it permits fluid flow therethrough; and G) a pH sensor for sensing the pH at a predetermined location and generating sensor signals representative of the sensed pH; and H) a control circuit responsive to the sensor signals to operate the pilot valve member by applying operator control signals to the pilot operator in response to predetermined characteristics of the sensed pH.

21. A flush-control mechanism comprising:

A) a body portion providing an inlet, an outlet, and a valve seat at the outlet, B) a cap secured to the body portion and forming therewith a composite chamber;

C) a diaphragm secured in the composite chamber, dividing the composite chamber into a main chamber and a pilot chamber and being flexible between an open state, in which it is spaced from the valve seat and permits flow from the inlet through the main chamber to the outlet, and a closed state, in which it seats against the valve seat and prevents flow from the inlet through the main chamber to the outlet, and providing a relief opening therethrough for flow from the pilot chamber to the outlet;

D) a partition forming a relief chamber communicating with the relief opening, generally separating the pilot chamber from the relief chamber and the relief opening but permitting flexure of the diaphragm and including a control portion, fixed in position with respect to the cap, that forms a pilot passage so positioned that the partition prevents flow between the pilot and relief chambers except through the pilot passage, and a flexible wall member extending between the fixed-position control portion and the diaphragm;

E) a pilot valve member;

F) a pilot operator, adapted for application of operator control signals thereto, for responding to the operator control signals by operating the pilot valve member between a first position, in which it closes the pilot passage so as to prevent fluid flow therethrough, and second position, in which it permits fluid flow therethrough;

G) a static-pressure sensor for sensing the static pressure at the predetermined location and generating signal signals representative of the sensed static pressure; and H) a control circuit for applying operator control signals to the operator but being responsive to the signal signals to refrain from operating the pilot operator when the sensed static pressure exceeds a predetermined value.

22. For converting to automatic operation a flush mechanism of the type that includes a body portion providing an inlet, an outlet, and a valve seat at the outlet, an original cap removably secured to the body portion and forming therewith a composite chamber, a diaphragm secured in the composite chamber, dividing the composite chamber into a main chamber and a pilot chamber, being flexible between an open state, in which it is spaced from the valve seat and permits flow from the inlet through the main chamber to the outlet, and a closed state, in which it seats against the valve seat and prevents flow from the inlet through the main chamber to the outlet, and providing a relief opening therethrough for flow from the pilot chamber to the outlet, and a pilot valve member operable between a first position, in which is prevents flow through the relief opening, and a second position, in which it permits such flow, a replacement assembly comprising:

A) a replacement cap that forms a composite chamber with the body when the replacement cap is mounted on the body in place of the original cap;

B) a partition including a control portion fixed in position with respect to the replacement cap and a flexible wall member extending between the fixed-position control portion and the diaphragm, the partition (i) forming a relief chamber communicating with the relief opening, (ii) permitting flexure of the diaphragm, and (iii) generally separating the pilot chamber from the relief chamber and the relief opening when the replacement cap is secured to the body, the control passage forming a pilot passage therethrough so positioned that the partition prevents flow between the pilot and relief chambers except through the pilot passage;

C) a replacement pilot valve member movably mounted for translation, when the replacement cap is mounted on the body in place of the original cap, between a first position, in which it closes the pilot passage so as to prevent fluid flow therethrough, and a second position, in which it permits fluid flow therethrough;

D) a pilot operator, secured to the replacement cap and adapted for application of operator control signals thereto, for responding to the operator control signals by operating the replacement pilot valve member between the first and second positions thereof;

E) a pressure sensor for sensing a pressure in the composite chamber and generating a pressure signal indicative thereof; and F) a control circuit responsive to the pressure signal for applying operator control signals to the operator so as to cause it to operate the pilot valve member to the second position for a period of time dependent on the pressure signal and then return it to the first position.

23. For converting to automatic operation a flush mechanism of the type that includes a body portion providing an inlet, an outlet, and a valve seat at the outlet, an original cap removably secured to the body portion and forming therewith a composite chamber, a diaphragm secured in the composite chamber, dividing the composite chamber into a main chamber and a pilot chamber, being flexible between an open state, in which it is spaced from the valve seat and permits flow from the inlet through the main chamber to the outlet, and a closed state, in which it seats against the valve seat and prevents flow from the inlet through the main chamber to the outlet, and providing a relief opening therethrough for flow from the pilot chamber to the outlet, and a pilot valve member operable between a first position, in which is prevents flow through the relief opening, and a second position, in which it permits such flow, a replacement assembly comprising:

A) a replacement cap that forms a composite chamber with the body when the replacement cap is mounted on the body in place of the original cap;

B) a partition including a control portion fixed in position with respect to the replacement cap and a flexible wall member extending between the fixed-position control portion and the diaphragm, the partition (i) forming a relief chamber communicating with the relief opening, (ii) permitting flexure of the diaphragm, and (iii) generally separating the pilot chamber from the relief chamber and the relief opening when the replacement cap is secured to the body, the control passage forming a pilot passage therethrough so positioned that the partition prevents flow between the pilot and relief chambers except through the pilot passage;

C) a replacement pilot valve member movably mounted for translation, when the replacement cap is mounted on the body in place of the original cap, between a first position, in which it closes the pilot passage so as to prevent fluid flow therethrough, and a second position, in which it permits fluid flow therethrough;

D) a pilot operator, secured to the replacement cap and adapted for application of operator control signals thereto, for responding to the operator control signals by operating the replacement pilot valve member between the first and second positions thereof;

E) a pH sensor for sensing the pH at a predetermined location and generating sensor signals representative of the sensed pH; and F) a control circuit responsive to the sensor signals to operate the pilot valve member by applying operator control signals to the pilot operator in response to predetermined characteristics of the sensed pH.

24. For converting to automatic operation a flush mechanism of the type that includes a body portion providing an inlet, an outlet, and a valve seat at the outlet, an original cap removably secured to the body portion and forming therewith a composite chamber, a diaphragm secured in the composite chamber, dividing the composite chamber into a main chamber and a pilot chamber, being flexible between an open state, in which it is spaced from the valve seat and permits flow from the inlet through the main chamber to the outlet, and a closed state, in which it seats against the valve seat and prevents flow from the inlet through the main chamber to the outlet, and providing a relief opening therethrough for flow from the pilot chamber to the outlet, and a pilot valve member operable between a first position, in which is prevents flow through the relief opening, and a second position, in which it permits such flow, a replacement assembly comprising:

A) a replacement cap that forms a composite chamber with the body when the replacement cap is mounted on the body in place of the original cap;

B) a partition including a control portion fixed in position with respect to the replacement cap and a flexible wall member extending between the fixed-position control portion and the diaphragm, the partition (i) forming a relief chamber communicating with the relief opening, (ii) permitting flexure of the diaphragm, and (iii) generally separating the pilot chamber from the relief chamber and the relief opening when the replacement cap is secured to the body, the control passage forming a pilot passage therethrough so positioned that the partition prevents flow between the pilot and relief chambers except through the pilot passage;

C) a replacement pilot valve member movably mounted for translation, when the replacement cap is mounted on the body in place of the original cap, between a first position, in which it closes the pilot passage so as to prevent fluid flow therethrough, and a second position, in which it permits fluid flow therethrough;

D) a pilot operator, secured to the replacement cap and adapted for application of operator control signals thereto, for responding to the operator control signals by operating the replacement pilot valve member between the first and second positions thereof;

E) a static-pressure sensor for sensing the static pressure at a predetermined location and generating sensor signals representative for the sensed static pressure; and F) a control circuit for applying operator control signals to the operator but being responsive to the sensor signals to refrain from operating the pilot operator when the sensed static pressure exceeds a predetermined value.

* * * * *